US012624296B2

(12) United States Patent
Pachpande et al.

(10) Patent No.: US 12,624,296 B2
(45) **Date of Patent: *May 12, 2026**

(54) PROCESS FOR REGENERATING CATALYST FROM A FLUIDIZED CATALYTIC PROCESS AT HIGH PRESSURE

(71) Applicant: UOP LLC, Des Plaines, IL (US)

(72) Inventors: Anil Nivrutti Pachpande, Gurugram (IN); Yogesh Kumar Gupta, Gurugram (IN); Jan De Ren, Bracknell (GB); Sakthivelan Maadasamy Durai, Gurugram (IN)

(73) Assignee: UOP LLC, Rosemont, IL (US)

( * ) Notice: Subject to any disclaimer, the term of this patent is extended or adjusted under 35 U.S.C. 154(b) by 225 days.

This patent is subject to a terminal disclaimer.

(21) Appl. No.: 18/144,790

(22) Filed: May 8, 2023

(65) Prior Publication Data

US 2024/0026228 A1 Jan. 25, 2024

Related U.S. Application Data

(60) Provisional application No. 63/485,194, filed on Feb. 15, 2023, provisional application No. 63/407,151, (Continued)

(51) Int. Cl.
*C10G 11/18* (2006.01)
*F25J 3/04* (2006.01)

(52) U.S. Cl.
CPC ..... *C10G 11/182* (2013.01); *C10G 11/185* (2013.01); *F25J 3/04533* (2013.01); *C10G 2300/708* (2013.01)

(58) Field of Classification Search
CPC ..... C10G 11/00; C10G 11/18; C10G 11/182; C10G 11/185; C10G 2300/708
See application file for complete search history.

(56) References Cited

U.S. PATENT DOCUMENTS 4,542,114 A 9/1985 Hegarty
5,597,537 A 1/1997 Wegerer et al.
(Continued)

FOREIGN PATENT DOCUMENTS

CN 103055961 A 4/2013
CN 113663741 A 11/2021
(Continued)

OTHER PUBLICATIONS

Alessandro Dal Pozzo, "Experimental Investigation of the Reactivity of Sodium Bicarbonate toward Hydrogen Chloride and Sulfur Dioxide at Low Temperatures", Mar. 14, 2019, Publisher: ACS Publications.

(Continued)

*Primary Examiner* — Prem C Singh
*Assistant Examiner* — Brandi M Doyle
(74) *Attorney, Agent, or Firm* — Paschall & Associates, LLC; James C. Paschall

(57) ABSTRACT

A process for regenerating catalyst from a fluidized catalytic process comprising is disclosed. The process comprises providing an oxygen stream and a preheated carbon dioxide recycle stream and mixing the oxygen stream and the preheated carbon dioxide recycle stream to provide a carbon dioxide rich oxidation stream. The carbon dioxide rich oxidation stream is passed to a regenerator unit to provide a carbon dioxide rich flue gas stream. One or more of a sulfur-containing compound, a nitrogen-containing compound, or both in the carbon dioxide rich flue gas stream is reacted with a reactant in a decontamination reactor to form a reactor effluent stream comprising reactant salt. The reactor effluent stream is filtered to remove the reactant salt and catalyst fines to produce a filtered reactor effluent stream. A carbon dioxide recycle stream is taken from the filtered reactor effluent stream.

19 Claims, 5 Drawing Sheets

Related U.S. Application Data filed on Sep. 15, 2022, provisional application No. 63/390,891, filed on Jul. 20, 2022.

(56) References Cited

U.S. PATENT DOCUMENTS

| | | | |
|---|---|---|---|
| 8,752,384 | B2 | 6/2014 | Polvi |
| 8,802,043 | B2 | 8/2014 | McDonald et al. |
| 8,932,456 | B2 | 1/2015 | Mello et al. |
| 10,589,264 | B2 | 3/2020 | Senetar |

FOREIGN PATENT DOCUMENTS

| | | | |
|---|---|---|---|
| CN | 113877397 | A | 1/2022 |
| EP | 0152845 | A1 | 8/1985 |
| JP | 2009507631 | A | 2/2009 |
| WO | 2022146872 | A1 | 7/2022 |

OTHER PUBLICATIONS

Yu Rong, "A Novel FCC Regeneration Process for Reduced CO 2 Emission", Apr. 2008.
Search Report and Written Opinion for PCT/US2023/028249 dated Oct. 31, 2023.
Search Report and Written Opinion for PCT/US2023/028252 dated Nov. 16, 2023.
Office Action for corresponding JP Application No. 2025-501276.
Office Action for corresponding JP Application No. 2024-576538.

PROCESS FOR REGENERATING CATALYST FROM A FLUIDIZED CATALYTIC PROCESS AT HIGH PRESSURE

CROSS-REFERENCE TO RELATED APPLICATIONS

This application claims priority from U.S. Provisional Application No. 63/390,891, filed Jul. 20, 2022, and U.S. Provisional Application No. 63/407,151, filed Sep. 15, 2022, and U.S. Provisional Application No. 63/485,194, filed Feb. 15, 2023, which is incorporated herein in its entirety.

FIELD

The field is related to a process and apparatus for regenerating catalyst from a fluidized catalytic process. Particularly, the field relates to a process for regenerating catalyst from a fluidized catalytic process with a carbon dioxide ($CO_2$) recycle stream.

BACKGROUND

Catalytic cracking can create a variety of products from larger hydrocarbons. Often, a feed of a heavier hydrocarbon, such as a vacuum gas oil, is provided to a catalytic cracking reactor, such as a fluid catalytic cracking reactor. Various products may be produced from such a system, including a gasoline product and/or light product such as propene and/or ethene.

Fluid catalytic cracking (FCC) is a hydrocarbon conversion process accomplished by contacting hydrocarbons in a fluidized reaction zone with a catalyst composed of finely divided particulate material. The reaction in catalytic cracking, as opposed to hydrocracking, is carried out in the absence of substantial added hydrogen or the consumption of hydrogen. As the cracking reaction proceeds substantial amounts of highly carbonaceous material referred to as coke is deposited on the catalyst. A high temperature regeneration operation within a regenerator zone combusts coke from the catalyst. Coke-containing catalyst, referred to herein as coked catalyst, is continually removed from the reaction zone and replaced by essentially coke-free catalyst from the regeneration zone. Fluidization of the catalyst particles by various gaseous streams allows the transport of catalyst between the reaction zone and regeneration zone. Spent catalyst from the reaction zone can be completely or partially regenerated in the regeneration zone.

A common objective of these configurations is maximizing product yield from the reactor while minimizing operating and equipment costs. Optimization of feedstock conversion ordinarily requires essentially complete removal of coke from the catalyst. This essentially complete removal of coke from catalyst is often referred to as complete regeneration. Complete regeneration produces a catalyst having less than 0.1 and preferably less than 0.05 wt-% coke. In order to obtain complete regeneration, the catalyst has to be in contact with oxygen at elevated temperature for sufficient residence time to permit thorough combustion.

Conventional regenerators typically include a vessel having a coked catalyst inlet, a regenerated catalyst outlet and a combustion gas distributor for supplying air or other oxygen containing gas to the bed of catalyst that resides in the vessel. Cyclone separators remove catalyst entrained in the flue gas before the gas exits the regenerator.

Alternative processes are also used for light olefins production. In one approach, hydrocarbon oxygenates and more specifically methanol or dimethyl ether are used as an alternative feedstock for producing light olefin products. Once the oxygenates are formed, the process includes catalytically converting the oxygenates, such as methanol, into the desired light olefin products in a methanol to olefin (MTO) process. In the MTO process, carbonaceous material, i.e., coke, is deposited on the catalyst as it moved through the reaction zones. The carbonaceous material is removed from the catalyst by oxidative regeneration in one or more regeneration zones wherein a moving bed of the catalyst particles withdrawn from the reaction zones is contacted with an oxygen-containing gas stream at sufficient temperature and oxygen concentration to allow the desired amount of the carbonaceous materials to be removed by combustion from the catalyst. In some cases, it is advantageous to only partially regenerate the catalyst, e.g., to remove from about 30 to 80 wt-% of the carbonaceous material.

Flue gas formed by burning the coke in the regenerator is treated for removal of particulates and conversion of carbon monoxide (CO), after which the flue gas is normally discharged into the atmosphere. Further, incomplete combustion to carbon monoxide can result from poor fluidization or aeration of the coked catalyst in the regenerator or poor distribution of coked catalyst into the regenerator. Generally, the flue gas exiting the regenerator contains carbon monoxide, carbon dioxide, nitrogen and water, along with smaller amounts of other species. Flue gas treatment methods are effective, but the capital and operating costs are high.

Conventional treatment of flue gas from FCC units and MTO units involve the use of wet gas scrubbing technology, such as a caustic scrubber, to remove sulfur compounds from the flue gas. In this process, the flue gas from the FCC regenerator is heat exchanged with boiler feed water to make steam and cool the flue gas. The flue gas is further cooled from a temperature of 400-500° F. to a temperature of 140-194° F. using a water quench. The cooled flue gas is contacted with sodium hydroxide which reacts with the sulfur compounds to form sodium sulfite ($Na_2SO_3$) and/or sodium sulphate ($Na_2SO_4$) and water, which are removed. Alternately, other suitable reagents or sea water can be used for removing the sulfur compounds in the flue gas. The flue gas can optionally be heated and treated to remove nitrogen compounds. The flue gas can also optionally be treated to remove catalyst fines and other particulate. The treated flue gas can then be discharged to the atmosphere.

The capital costs of the system are high, as are the operating costs due to the use of sodium hydroxide or other reagents, water, electricity, flocculants, and slurry handling. Moreover, the system requires a large area and is maintenance intensive. The wet scrubber process has a high make-up water requirement due to water quenching and the use of aqueous sodium hydroxide. The system also suffers from corrosion problems related to the use of sulfuric acid ($H_2SO_4$), and spray nozzle fouling concerns due to the presence of salts. A substantial amount of sensible energy is not recovered because of acid dew point limitations. The poor energy recovery is due to the high stack temperature and poor thermal profile (quench the boiler flue gas outlet to adiabatic saturation for allowing wet sulfur removal and in some cases subsequently reheating the flue gas to the needed Selective Catalytic Reduction (SCR) inlet temperature requirement to allow nitrogen (NOx) removal. This may result in a negative energy balance. Furthermore, there can be issues of sulfuric acid, blue plumes caused by formed submicron aerosols and white plumes caused by water condensation when flue gas is emitted to atmosphere. This can be avoided by heating of the stream, but that increases capital and operating costs. After treatment the treated flue gas in generally released in the atmosphere or send for further recovery of elements from the flue gas.

Environmental concerns over greenhouse gas emissions have led to an increasing emphasis on separating the greenhouse gases before releasing the flue gases into atmosphere. Carbon dioxide) is the most significant long-lived greenhouse gas in earth's atmosphere. Carbon dioxide capture from flue gases is still expensive, both from a capital expenditures and operational utility costs standpoint. For fluidized catalytic processes, air is used for regenerating the spent catalyst. As a result of this operation, the carbon dioxide in the FCC flue gas has a lower amount in contrast to the amount of undesired components from a carbon dioxide capture perspective—resulting in high capital expenditures due to a large volume of the flue gas, but also large operational utility costs as high solvent circulating rates and solvent regeneration duties. Apart from this, the flue gas requires extensive flue gas treatment prior to carbon capture in order to meet stringent specifications to avoid high solvent degradation rates. This is resulting in high capital expenditures and operational utility costs with various and longer impurities removal operations. Additionally, typically wet gas scrubbers are used, which result in poor energy recovery from the flue gas, high make-up water, corrosion and fouling related issues in the plants, slurry handling challenging and risk for blue plumes, in addition to white plumes as a result of water condensation upon emission to the atmosphere.

Therefore, there is a need for improved processes for treating flue gas containing carbon dioxide. Also, there is a need for a process and an apparatus which reduces capital expenditures and operational utility costs of the carbon dioxide capture section as flue gas treatment section, whilst improving energy efficiency and energy recovery.

SUMMARY

The present disclosure provides a process and an apparatus for regenerating catalyst from a fluidized catalytic process. Generally, atmospheric air is used in the regenerator for burning the coke from spent catalyst. Atmospheric air has a high amount (79 mol %) of nitrogen (N2) which leads to a low carbon dioxide partial pressure. This results in a lower amount of carbon dioxide in the FCC flue gas such as between 15-25 mol %, whereas the balance are undesired components. The present process discloses providing a carbon dioxide rich oxidation stream to the regenerator in place of air. The flue gas from the regenerator in accordance with the present process has an economically desirable amount of carbon dioxide from a carbon dioxide capture perspective as compared to the undesired components due to use of air in regenerator.

The present disclosure provides separating a carbon dioxide recycle stream from the flue gas stream and mixing the carbon dioxide recycle stream with an oxygen stream and passing the carbon dioxide rich oxidation stream to the regenerator for burning coke from the spent catalyst. The carbon dioxide rich oxidation stream provides a substantially nitrogen-free atmosphere within the regenerator and reduces the amount of undesirable components in the flue gas from a carbon dioxide capture perspective. The substantially nitrogen-free regeneration process will allow significant size reduction of the regenerator, the flue gas treatment section and the carbon capture section. The process and the apparatus will increase the capacity for existing units. The carbon dioxide rich oxidation stream provides a substantially nitrogen free condition and ameliorates the need for a high temperature regenerator when air is passed to the regenerator due to the higher molar heat capacity of carbon dioxide compared to nitrogen.

Further, the present process provides a dry scrubbing step for the treatment of the flue gas. The dry scrubbing step avoids corrosion issues as compared to the wet scrubbing step. The dry scrubbing step also eliminates blue/white plume potential due to water condensation and/or sulfuric acid aerosols in a wet scrubbing step. The process also provides a heat integration between the carbon dioxide recycle stream and the dry scrubbing step providing substantial increase in energy recovery from flue gas enabled via dry scrubbing.

BRIEF DESCRIPTION OF THE DRAWINGS

The various embodiments will hereinafter be described in conjunction with the following FIGURES, wherein like numerals denote like elements.

DEFINITIONS

Figure 1:
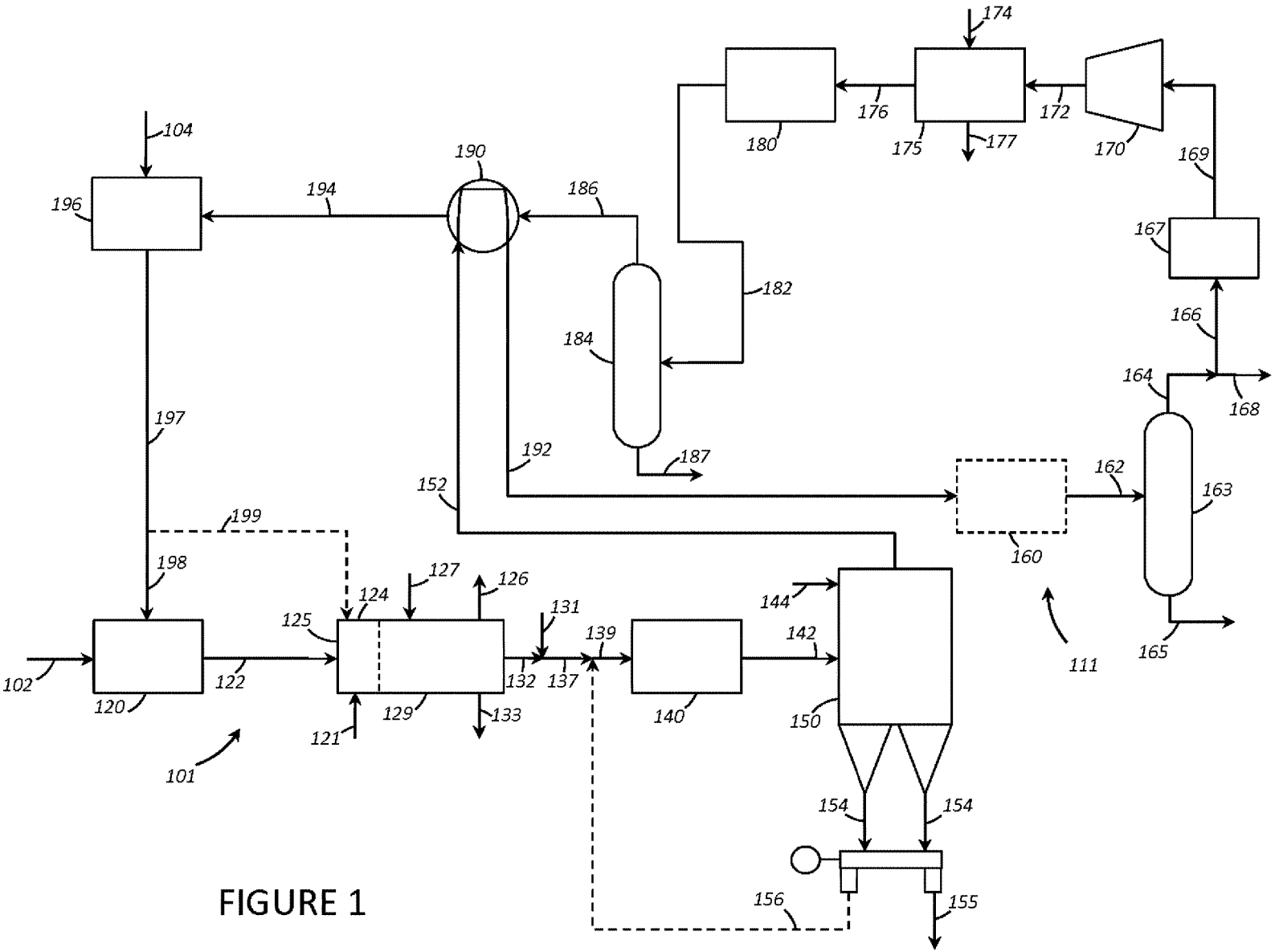
FIG. 1 is a schematic diagram of a process and an apparatus for regenerating catalyst from a fluidized catalytic process in accordance with an exemplary embodiment.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" or "directly" means that flow from the upstream component enters the downstream component without passing through a fractionation or conversion unit to undergo a compositional change due to physical fractionation or chemical conversion.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The top pressure is the pressure of the overhead vapor at the vapor outlet of the column. The bottom temperature is the liquid bottom outlet temperature. Overhead lines and bottoms lines refer to the net lines from the column downstream of any reflux or reboil to the column. Stripper columns may omit a reboiler at a bottom of the column and instead provide heating requirements and separation impetus from a fluidized inert media such as steam. Stripper columns typically feed a top tray and take the main product from the bottom.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator that may be operated at higher pressure.

As used herein, the term "a component-rich stream" means that the rich stream coming out of a vessel has a greater concentration of the component than the feed to the vessel.

As used herein, the term "rich" means greater than 50%, suitably greater than 75% and preferably greater than 90%.

DETAILED DESCRIPTION

A process for regenerating catalyst from a fluidized catalytic process is disclosed. The process involves the use of a dry sorbent injection (DSI) unit to remove sulfur compounds from flue gas produced from regenerating catalyst from a fluidized catalytic process. The fluidized catalytic process can be any fluid catalytic process that regenerates catalyst including a FCC process or a MTO process. The flue gas from a regenerator of a fluidized catalytic process, is used to make superheated steam and saturated steam. The flue gas is then sent to a DSI unit to remove the sulfur compounds, and then to a heat recovery exchanger which might be a heat exchanger to heat a carbon dioxide recycle stream as described hereinafter in detail. Because the flue gas temperature does not decrease as much as it is in a wet scrubber process, additional thermal energy can be recovered from the flue gas in the heat recovery exchanger.

By utilizing dry sorbent injection (DSI) systems, the unharvested sensible energy can be captured, substantially improving the energy efficiency of the process and avoiding negative energy balances. The energy efficiency increase achieved by utilizing DSI systems in lieu of wet gas scrubber systems can also be applied to any type of fluidized catalytic process where flue gas is generated with an SOx concentration above the environmental limit.

The process results in a substantial increase in energy recovery due to the addition of the heat recovery exchanger downstream of the DSI (or a selective catalytic reduction unit if present). The heat integration in accordance with the present process recovers additional energy.

Further, heat can also be recovered from the flue gas before or after the DSI for preheating boiler feed water used in the heat recovery steam generator (HRSG) boiler and/or catalyst cooler and/or CO combustor, thereby reducing or eliminating the possibility for negative energy balances. Alternately, low-pressure (LP) or medium pressure (MP) steam can be produced which can be used in the FCC process and other processes.

Sulfur removal upstream of the heat recovery exchanger reduces tube corrosion risks and greatly increases system reliability. The disclosed process reduces or eliminates concern due to corrosion from sulfuric acid. Avoiding operation in the corrosive regime eliminates the need for a stainless-steel flue gas scrubber; the complete system can be made from carbon steel.

Because the DSI technology does not require water and water is considered a scarce resource, the water usage by the system is significantly reduced. The process also eliminates spray nozzle fouling concerns in wet gas scrubber by avoiding the need for complex slurry handling, white plumes as a result of water condensation, and blue plumes as a result of sulfuric acid aerosol emissions. In addition, NOx reductions up to 21% may be achieved when using $NaHCO_3$ as the DSI reactant and the system pressure drop can be up to 50% lower.

When air is used as a combustion gas, high amounts of inerts particularly nitrogen (N2) end up in the regenerator flue gas leading to a lower carbon dioxide partial pressure. This occupies unnecessary volume resulting in large equipment sizes for regenerator and downstream flue gas treatment equipment. Due to a low carbon dioxide partial pressure, the cost of carbon dioxide capture is relatively high, which may be a reason for a reluctance of refiners towards implementing carbon dioxide ($CO_2$) capture technology. The process replaces the air with a carbon dioxide rich oxidation stream comprising carbon dioxide and up to 30 mole % of oxygen. The carbon dioxide rich oxidation stream comprising carbon dioxide and oxygen provides a significant increase in carbon dioxide partial pressure in the flue gas and enables low capital expenditures and operational utility costs for carbon dioxide capture.

In a wet scrubbing step, the flue gas must be saturated by passing quench media. So, the flue gas post wet scrubbing is at a low temperature of 140-200° F. In comparison, dry scrubbing can be performed at a higher temperature of 300-600° F. It is proposed to recover the heat/energy from the flue gas stream after dry scrubbing to reduce overall capital expenditures. The present process recovers heat from the flue gas after dry scrubbing by a heat recovery exchanger. While the heat recovery exchanger may be used for heat exchange with carbon dioxide recycle stream, the recycle carbon dioxide stream can be heated to a desired temperature level for passing it to the regenerator without a need for external heat utilities. Further, the process withdraws the carbon dioxide recycle stream from the flue gas stream after the dry scrubbing step.

In a FCC process, the flue gas from the regenerator is generally passed to a third stage separator (TSS) to separate catalyst fines from the flue gas. A small quantity of flue gas with most of the catalyst fines is taken as an underflow stream from the TSS. The rest of the flue gas is separated in an overflow stream from the TSS. The catalyst fines from the underflow stream from the TSS are further separated. The underflow stream from the TSS is passed to a fourth stage separator to separate catalyst fines. TSS in the FCC process can be directly integrated with the filter section. Thus, the fourth stage separator for the underflow stream from TSS can be omitted. Accordingly, the underflow stream from TSS is directly passed to the filter section for the removal of catalyst fines. Also, energy can be extracted from the overflow stream from the TSS. The overflow stream from the TSS flows to an expander turbine, where energy is extracted in the form of work. The expander may be coupled with the main air blower, providing power for blower operation or the air blower may be driven by a separate electric motor or steam turbine with expander output used solely for electric power generation. If the expander is coupled with the air blower, a motor/generator is required in the train to balance expander output with the air blower power requirement, and a steam turbine is included to assist with start-up. The steam turbine may be designed for continuous operation as an economic outlet for excess steam, or a less expensive turbine exhausting to atmosphere may be installed for use only during start-up. In an exemplary embodiment, the expander is coupled with a generator for blue electricity generation.

The flue gas from the regenerator in an FCC process may include unconverted carbon monoxide. The unconverted carbon monoxide in the flue gas can be combusted to carbon dioxide in a CO combustor that produces high-pressure steam. The flue gas is removed from the regenerator and charged to the CO combustor in heat recovery section where a combustion air stream is added to burn the flue gas releasing heat which is recovered. The use of air in the CO combustor can also lead to a buildup of nitrogen gas in the flue gas stream obtained from CO combustor. This nitrogen from the CO combustor can be eliminated by replacing the air fed to the CO combustor, the dry air (DA) purge points and other purges like fluffing air in the regenerator with a portion of the carbon dioxide rich oxidation stream comprising oxygen and the recycle carbon dioxide stream. Thus, for an FCC process, the carbon dioxide rich oxidation stream is separated into a first portion and a second portion. The first portion of the carbon dioxide rich oxidation stream is passed to a regenerator unit and the second portion of the carbon dioxide rich oxidation stream is passed to the heat recovery section.

The regenerator unit can be a partial burn unit or a complete burn unit. In a partial burn regenerator unit, the flue gas contains carbon monoxide, typically up to about 10%, and more specifically between about 2% to about 5%, which is used as the primary fuel source in a downstream CO combustor or combustion chamber where the flue gas is burned releasing heat which is recovered. By running the regenerator in a partial burn mode to maximize the carbon monoxide yield the unit will limit the amount of heat released in the regenerator relative to completely burning the coke to carbon dioxide. This will lower the regenerator temperature and permit a higher catalyst to oil ratio in the FCC riser.

In FIG. 1, in accordance with an exemplary embodiment, a process and apparatus 101 is shown for regenerating catalyst from a fluidized catalytic process. The apparatus for regenerating catalyst comprises a regenerator unit 120, a heat recovery section 125, a decontamination reactor 140, a filter section 150, a heat exchanger 190, and a carbon dioxide separation section 111. One aspect of the present disclosure comprises a process for regenerating catalyst from a fluidized catalytic process. The method comprises providing an oxygen stream in line 104. Usually, the oxygen stream is provided from an air separation unit (ASU). However, applicant has found an oxygen stream may be taken from an electrolyzer. Thus, the oxygen stream in line 104 may be provided from the electrolyzer. The carbon dioxide recycle stream in line 186 is preheated in a heat exchanger 190 to provide a preheated carbon dioxide recycle stream in line 194. The oxygen stream in line 104 and the preheated carbon dioxide recycle stream in line 194 are passed to a mixing unit or mixer 196 to provide a carbon dioxide rich oxidation stream in line 197. The carbon dioxide rich oxidation stream in line 197 is passed to the regenerator unit 120. A spent catalyst stream from a fluidized catalytic process in line 102 is also passed to the regenerator unit 120. In an aspect, the carbon dioxide rich oxidation stream in line 197 comprises an oxygen concentration of no more than 30 mole %.

In a fluidized catalytic process, catalyst particles are repeatedly circulated between a reaction zone and a catalyst regenerator unit 120. During regeneration, coke deposited on the catalyst particles during reactions in the reaction zone is removed at elevated temperatures by oxidation in the regenerator unit 120. The removal of coke deposits restores the activity of the catalyst particles to the point where they can be reused in the reaction zone. The present disclosure is directed towards handling the flue gas stream from the regenerator. The regenerated catalyst is withdrawn (not shown in FIG. 1) from the regenerator unit 120 and handled as known in the art.

From the regenerator unit 120, a carbon dioxide rich flue gas stream in line 122 is withdrawn. The carbon dioxide rich flue gas stream in line 122 is usually at a high temperature and heat can be recovered from the carbon dioxide rich flue gas stream in line 122 prior to further treatment. The carbon dioxide rich flue gas stream in line 122 is passed to a heat recovery section 125 for transferring heat from the carbon dioxide rich flue gas stream in line 122 to a boiler feed water stream in line 127 to form a partially cooled carbon dioxide rich flue gas stream in line 132 and a steam stream in line 126. The heat recovery section 125 can include a HRSG or a CO combustor and a HRSG. As described herein above, when the regenerator unit 120 is operating under partial burn, a portion of the carbon dioxide rich oxidation stream in line 197 is passed to the CO combustor in line 199 to prevent nitrogen build up in the flue gas stream. The carbon dioxide rich oxidation stream in line 197 is separated into a first portion in line 198 and a second portion in line 199. The first portion of the carbon dioxide rich oxidation stream in line 198 is passed to the regenerator unit 120 and the second portion of the carbon dioxide rich oxidation stream in line 199 is passed to the CO combustor in the heat recovery section 125.

Under partial burn operation, the carbon dioxide rich flue gas stream in line 122 is sent to a CO combustor 124 in the heat recovery section 125 with a fuel gas stream 121 and the second portion of the carbon dioxide rich oxidation stream in line 199 to oxidize the carbon monoxide present in the carbon dioxide rich flue gas stream in line 122 to carbon dioxide. A fully combusted stream from the carbon monoxide combustor is then sent to the HRSG unit 129 in the heat recovery section 125. In an exemplary embodiment, the flue gas outlet temperature for the FCC regenerator for a partial combustion or a full combustion FCC regenerator may range from about 670 to about 740° C. or from about 650 to about 700° C. The flue gas temperature departing the CO combustor may range from about 890 to about 1040° C.

For a full burn regenerator unit 120, the heat recovery section 125 includes only a HRSG unit 129, and the CO combustor 124 is not present. So, under a full burn regenerator unit 120, the carbon dioxide rich flue gas stream in line 122 is sent to the HRSG unit 129. A full or partial combustion MTO regenerator may operate at a temperature ranging from about 670° C. to about 740° C. or from about 650° C. to about 700° C. In the HRSG, the hot flue gas is indirectly heat exchanged with water in line 127 to produce steam in line 126 and condensate stream in line 133. The steam stream in line 126 and the condensate in line 133 is withdrawn from the HRSG unit 129. A partially cooled carbon dioxide rich flue gas stream in line 132 is withdrawn from the heat recovery section 125. The partially cooled carbon dioxide rich flue gas stream in line 132 is treated to remove impurities. The flue gas outlet temperature from the HRSG for a partial combustion FCC regenerator, or the full combustion FCC or MTO process may range from about 200° C. to about 290° C.

The partially cooled carbon dioxide rich flue gas stream in line 132 is passed to the decontamination reactor 140. A reactant in line 131 is also passed to the decontamination reactor 140. In an embodiment, the reactant in line 131 is in dry form. In an aspect, the partially cooled carbon dioxide rich flue gas stream in line 132 from the heat recovery section 125 is mixed with the dry reactant 131 to provide a mixed stream in line 137 and sent to the decontamination reactor 140 together in the mixed stream 137 where the reactant reacts with the sulfur-containing compounds and/or nitrogen-containing compound in the partially cooled carbon dioxide rich flue gas stream in line 132 to form a reactor effluent stream comprising reactant salt in line 142. As the reactant 131 is used in dry form, the decontamination reactor 140 can be operated at a higher temperature compared to a slurry form of reactant. In an exemplary embodiment, the decontamination reactor 140 operates at a temperature from about 200° C. to about 600° C. or from about 300° C. to about 600° C. for reacting one or more of the sulfur-containing compounds, the nitrogen-containing compound, or both in the partially cooled carbon dioxide rich flue gas stream in line 132 with the reactant 131 in dry form. In another exemplary embodiment, the reactant 131 comprises one or more of sodium bicarbonate ($NaHCO_3$), calcium hydroxide ($Ca(OH)_2$) and trona salt ($Na_2CO_3 \cdot NaHCO_3 \cdot 2H_2O$). In yet another exemplary embodiment, the reactant salt comprises one or more of sodium sulphate ($Na_2SO_4$), sodium carbonate ($Na_2CO_3$) and sodium nitrate ($NaNO_3$). The reactor effluent stream comprising reactant salt in line 142 is passed to a filter section 150 for particle removal.

The filter section 150 removes particulate and fines from the reactor effluent stream in line 142. Electricity is supplied to the filter section 150 when the filter section 150 comprises an electrostatic precipitator. The filter section 150 may also comprise a bag filter. The filtered material from the filter section 150 may include one or more of sodium sulphate ($Na_2SO_4$), sodium nitrate ($NaNO_3$), sodium nitrite ($NaNO_2$), sodium carbonate ($Na_2CO_3$), and catalyst fines which may be removed in the filter section 150. A filtered material 154 can be removed from the process in line 155. Alternatively, or additionally, a filtered material may be recycled to the decontamination reactor 140 as a recycled filtered material in line 156 to increase the sodium carbonate conversion yield. The recycled filtered material in line 156 may be recycled with the mixed stream in line 137 and sent to the decontamination reactor 140 in line 139. Thus, the reactant salt and catalyst fines are removed from the reactor effluent stream 142 in the filter section 150 to produce a filtered reactor effluent stream in line 152. The filtered reactor effluent stream in line 152 is passed to the carbon dioxide separation section 111 to separate carbon dioxide from the filtered reactor effluent stream. The separation section 111 may comprise a heat exchanger 190, coolers 160 and 180, knock out drums (KOD) 163 and 184 for separation, a heater 167, a compressor 170, and a generator 175.

Because the reactant is used in dry form, the filtered reactor effluent stream in line 152 is still has a significantly high temperature. Heat/energy can still be recovered from the filtered reactor effluent stream in line 152. The filtered reactor effluent stream in line 152 is heat exchanged with the carbon dioxide recycle stream in line 186 in the heat exchanger 190 to provide a preheated carbon dioxide recycle stream in line 194 and a partially cooled filtered reactor effluent stream in line 192. In an exemplary embodiment, the heat exchanger 190 is a gas-to-gas type heat exchanger. Optionally, the partially cooled filtered reactor effluent stream in line 192 may be cooled in a first cooler 160 and passed to a first knockout drum (KOD) 163. Alternatively, the partially cooled filtered reactor effluent stream in line 192 may be passed directly to the first knockout drum (KOD) 163 without further cooling. The first cooler 160 may use cooling water and/or chilled water as cooling medium. Alternatively, the first cooler 160 can be an air cooler. In an aspect of the present disclosure, the first cooler 160 may be optional and the cooled filtered reactor effluent stream in line 192 may be directly passed to the first KOD 163.

In the first KOD 163, water is separated from a cooled filtered reactor effluent stream in line 162 to provide a carbon dioxide stream which is withdrawn from the top of the KOD in line 164. Water is withdrawn in stream 165 from the bottom of the first KOD 163. The present process recycles the carbon dioxide stream in line 164 to the regenerator unit 120. Accordingly, a portion or all of the carbon dioxide stream in line 164 can be taken and mixed with the oxygen stream 104 to provide the carbon dioxide rich oxidation stream 197 for the regenerator unit 120. In an embodiment, the carbon dioxide stream is separated into the carbon dioxide stream for recycling in line 166 and a separated carbon dioxide stream in line 168. The separated carbon dioxide stream in line 168 may be withdrawn and sent for storage. The separated carbon dioxide stream in line 168 may require treatment in a pressure swing adsorption (PSA) unit or a thermal swing adsorption (TSA) unit for trace removal of contaminants like $SO_x$, $NO_x$, $NH_3$, $O_2$, and $H_2O$. The separated carbon dioxide stream in line 168 may be treated accordingly and sent to storage. In accordance with the process, the carbon dioxide stream for recycling in line 166 may be further treated before recycling to the regenerator unit 120.

The carbon dioxide stream for recycling in line 166 may be passed to a carbon dioxide recycle compressor 170 to provide a compressed carbon dioxide recycle stream in line 172. The compressed carbon dioxide recycle stream in line 172 can be passed to a generator 175 to provide a partially cooled carbon dioxide recycle stream in line 176 and a steam stream in line 177 from a water stream in line 174. The steam stream in line 177 may be used for electricity generation purposes. In an exemplary embodiment, the generator 175 is a low-pressure steam generator 175 to provide a low-pressure steam stream. The partially cooled carbon dioxide recycle stream in line 176 is cooled in a second cooler 180 to provide a cooled carbon dioxide recycle stream in line 182 which is passed to a second knockout drum (KOD) 184. The second cooler 180 can be an air cooler. Alternatively, the second cooler 180 may use cooling water and/or chilled water as cooling medium. The compressed carbon dioxide recycle stream in line 172 at the outlet of the carbon dioxide recycle compressor 170 is at a high temperature. The compressed carbon dioxide recycle stream in line 172 may have a temperature of about 220° C. (428° F.) to about 260° C. (471° F.). Generally, a boiler feed water (BFW) is required to be heated from about 121° C. (250° F.) to about 177° C. (350° F.). In accordance with the process, the compressed carbon dioxide recycle stream in line 172 may be used to preheat a BFW stream in a BFW preheater (not shown). Therefore, the compressed carbon dioxide recycle stream in line 172 may be passed to a BFW preheater before passing it to the second cooler 180.

The cooling and condensing of the cooled filtered reactor effluent stream in line 192 using the first cooler 160 may result in aqueous phase formation. This could lead to carbonic acid formation due to the reaction of carbon dioxide with water. The formation of carbonic acid may cause carbonic acid corrosion to the heat exchanger 190, first cooler 160, first KOD 163 and other downstream equipment. Therefore, the metallurgy of first cooler 160 and the first KOD 163 is suitably selected to withstand any carbonic acid corrosion. In accordance with an embodiment of the present disclosure, a heater 167 may be present upstream of the carbon dioxide recycle compressor 170. In accordance with an aspect, the heater 167 may be used to increase the temperature of the carbon dioxide stream for recycling in line 166 to provide a heated carbon dioxide stream for recycling in line 169 which is passed to the carbon dioxide recycle compressor 170. In accordance with an exemplary embodiment, the carbon dioxide stream for recycling in line 166 is passed through the heater 167 to increase the temperature of the carbon dioxide stream by about 5° C. (9° F.) to about 50° C. (90° F.) above the dew point of the carbon dioxide stream to avoid carbonic acid corrosion in any of the downstream equipment. The heated carbon dioxide stream for recycling in line 169 is passed to the carbon dioxide recycle compressor 170 to provide the compressed carbon dioxide recycle stream in line 172 and passed to the low-pressure steam generator 175 and the second cooler 180 as described above. The heater 167 is advantageously located downstream of the first KOD 163 to permit greater condensation of water and its separation in the KOD.

In the second KOD 184, water is separated from the cooled carbon dioxide recycle stream in line 182 to provide a dry carbon dioxide recycle stream which is withdrawn from the top of KOD in line 186. Water is withdrawn in stream 187 from the bottom of the second KOD 184. The dry carbon dioxide recycle stream in line 186 is heat exchanged with the filtered reactor effluent stream in line 152 in the heat exchanger 190 to provide a preheated dry carbon dioxide recycle stream in line 194. The preheated dry carbon dioxide recycle stream in line 194 is passed to the regenerator unit 120 after mixing with the oxygen stream in line 104 in the mixer 196. In some embodiments, a de-oxygenation operation may also be included in the separation section 111 or the decontamination reactor 140 in order to meet the specifications for carbon dioxide use.

Figure 2:
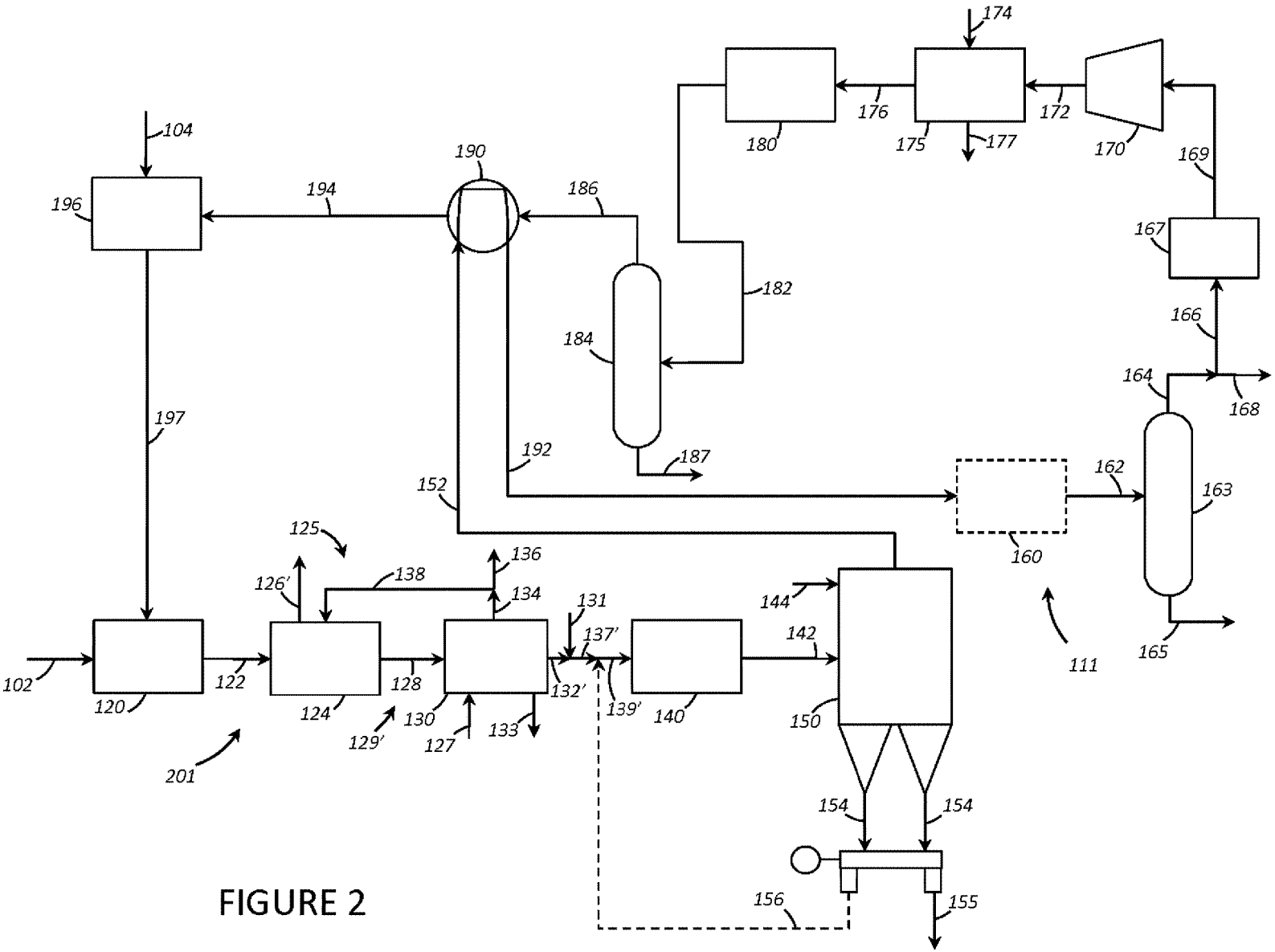
FIG. 2 is a schematic diagram of a process and an apparatus for regenerating catalyst from a fluidized catalytic process in accordance with another exemplary embodiment.

Turning now to FIG. 2, another exemplary embodiment of a process and an apparatus for regenerating catalyst from a fluidized catalytic process is addressed with reference to a process and apparatus 201. Elements of FIG. 2 may have the same configuration as in FIG. 1 and bear the same respective reference number and have similar operating conditions. The fluidized catalytic process as shown in FIG. 2 is a FCC process operating under full burn conditions. Accordingly, the heat recovery section 125 has no CO combustor. The heat recovery section 125 comprises a HRSG 129.

The carbon dioxide rich oxidation stream in line 197 is passed to an FCC regenerator unit 120 operating under full burn conditions. From the regenerator unit 120, a carbon dioxide rich flue gas stream in line 122 is withdrawn. The carbon dioxide rich flue gas stream in line 122 is passed to the heat recovery section 125 for recovering heat from the carbon dioxide rich flue gas stream in line 122. In an exemplary embodiment, the heat recovery section 125 is a HRSG 129'. The HRSG 129' comprises a superheated steam section 124 and a saturated steam section 130. The carbon dioxide rich flue gas stream in line 122 is passed to the superheated steam section 124 of the HRSG 129' to transfer heat to a portion steam stream in line 138 and produce a superheated steam stream in line 126' and a heat exchanged carbon dioxide rich flue gas stream in line 128. The heat exchanged carbon dioxide rich flue gas stream in line 128 is sent to the saturated steam section 130 of the HRSG 129'. In the saturated steam section 130, a boiler feed water stream 127 is heated by the heat exchanged carbon dioxide rich flue gas stream in line 128 forming a saturated steam stream in line 134 and a partially cooled carbon dioxide rich flue gas stream in line 132'. A condensate stream in line 133 is withdrawn from the saturated steam section 130. A portion steam stream in line 138 of the saturated steam stream 134 is sent to the HRSG superheated steam section 124 to be superheated. The remainder stream in line 136 of the saturated steam stream in line 134 can be sent to other parts of the plant for use as needed. The partially cooled carbon dioxide rich flue gas stream in line 132' is withdrawn from the saturated steam section 130 and passed to the decontamination reactor 140. The dry reactant 131 may be mixed with the partially cooled carbon dioxide rich flue gas stream in line 132' to provide a mixed stream in line 137'. The mixed stream in line 137' is passed to the decontamination reactor 140. The recycled filtered material in line 156 may be recycled with the mixed stream in line 137' and sent to the decontamination reactor 140 in line 139'. The rest of the process is the same as described in FIG. 1.

Figure 3:
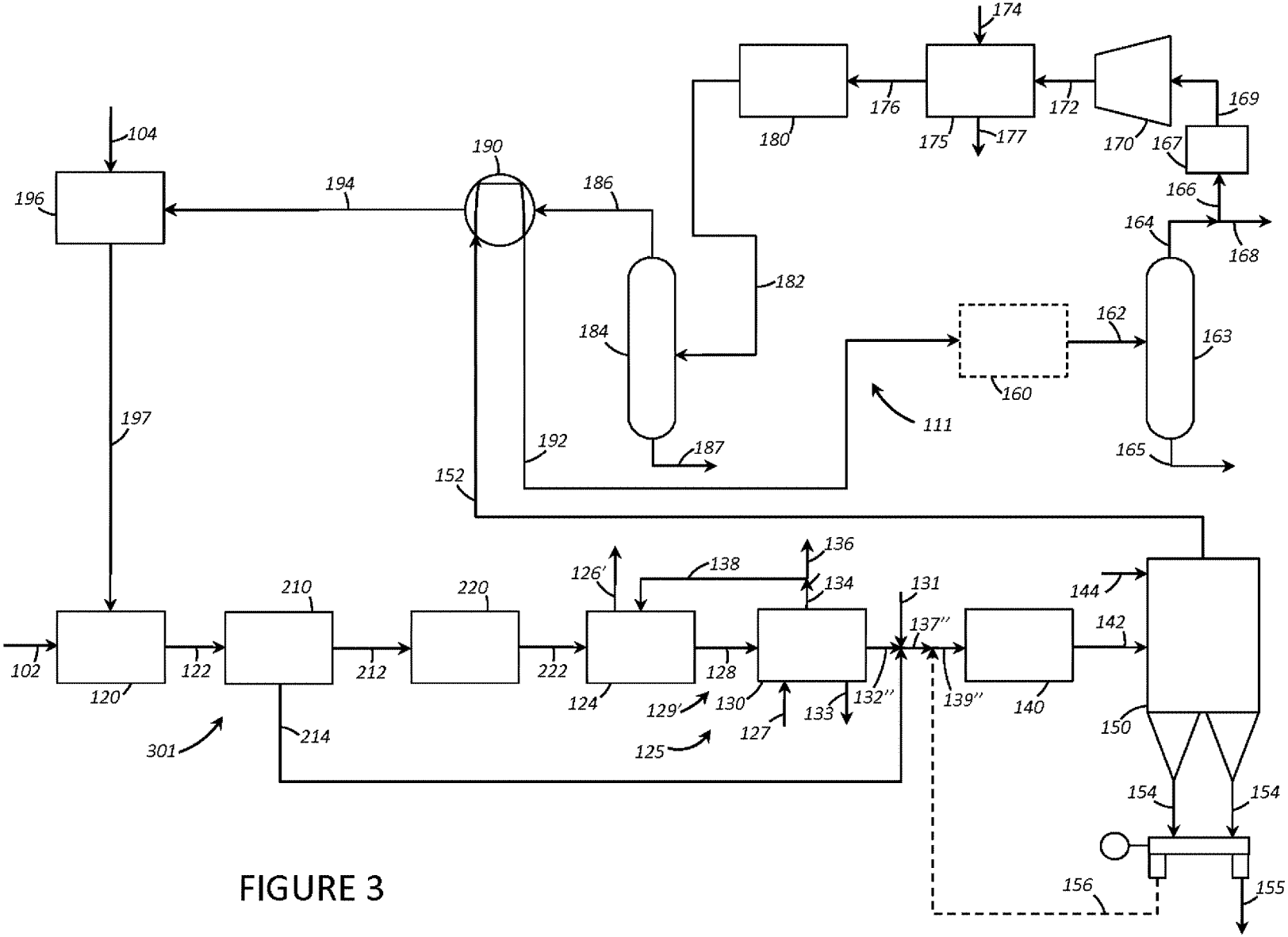
FIG. 3 is a schematic diagram of a process and an apparatus for regenerating catalyst from a fluidized catalytic process in accordance with yet another exemplary embodiment.

Yet another exemplary embodiment of a process and an apparatus for regenerating catalyst from a fluidized catalytic process is addressed with reference to a process and apparatus 301 as shown in FIG. 3. Elements of FIG. 2 may have the same configuration as in FIG. 2 and bear the same respective reference number and have similar operating conditions. The process and apparatus for regenerating catalyst from a fluidized catalytic process as shown in FIG. 3 comprise a third stage separator (TSS) (210) and a flue gas expander (220) in addition to the elements shown in FIG. 2.

The carbon dioxide rich flue gas stream in line 122 is passed to the TSS 210 to separate catalyst fines in an underflow stream in line 214. A carbon dioxide rich flue gas stream with reduced catalyst fines is separated in an overflow stream in line 212 from the TSS 210. The catalyst fines from the underflow stream in line 214 from the TSS 210 are further concentrated in the underflow stream in line 214. The underflow stream in line 214 from the TSS 210 is passed directly to the decontamination reactor 140. In an exemplary embodiment, the underflow stream in line 214 is combined with the partially cooled carbon dioxide rich flue gas stream in line 132" to provide a combined partially cooled carbon dioxide rich flue gas stream in line 137" which is passed to the decontamination reactor 140. In another exemplary embodiment, the partially cooled carbon dioxide rich flue gas stream in line 132" and the underflow stream in line 214 are passed to the decontamination reactor 140 separately. The recycled filtered material in line 156 may be recycled with the combined partially cooled carbon dioxide rich flue gas stream in line 137" and sent to the decontamination reactor 140 in line 139". The catalyst fines from the underflow stream in line 214 are separated in the filter section 150. The separated catalyst fines are removed in line 155 from the filter section 150. Thus, the instant process discloses a direct integration between the TSS of the FCC process with the decontamination reactor 140 and/or the filter section 150.

Returning to the TSS 210, the carbon dioxide rich flue gas stream with reduced catalyst fines in the overflow stream in line 212 is passed to the flue gas expander 220 where energy is extracted in the form of work and/or electricity as described herein above. In an exemplary embodiment, the expander 220 is coupled with a generator for blue electricity generation. After electricity generation, an overflow stream in line 222 from the flue gas expander 220 is passed to the heat recovery section 125. The rest of the process is same as described in FIG. 2.

Figure 4:
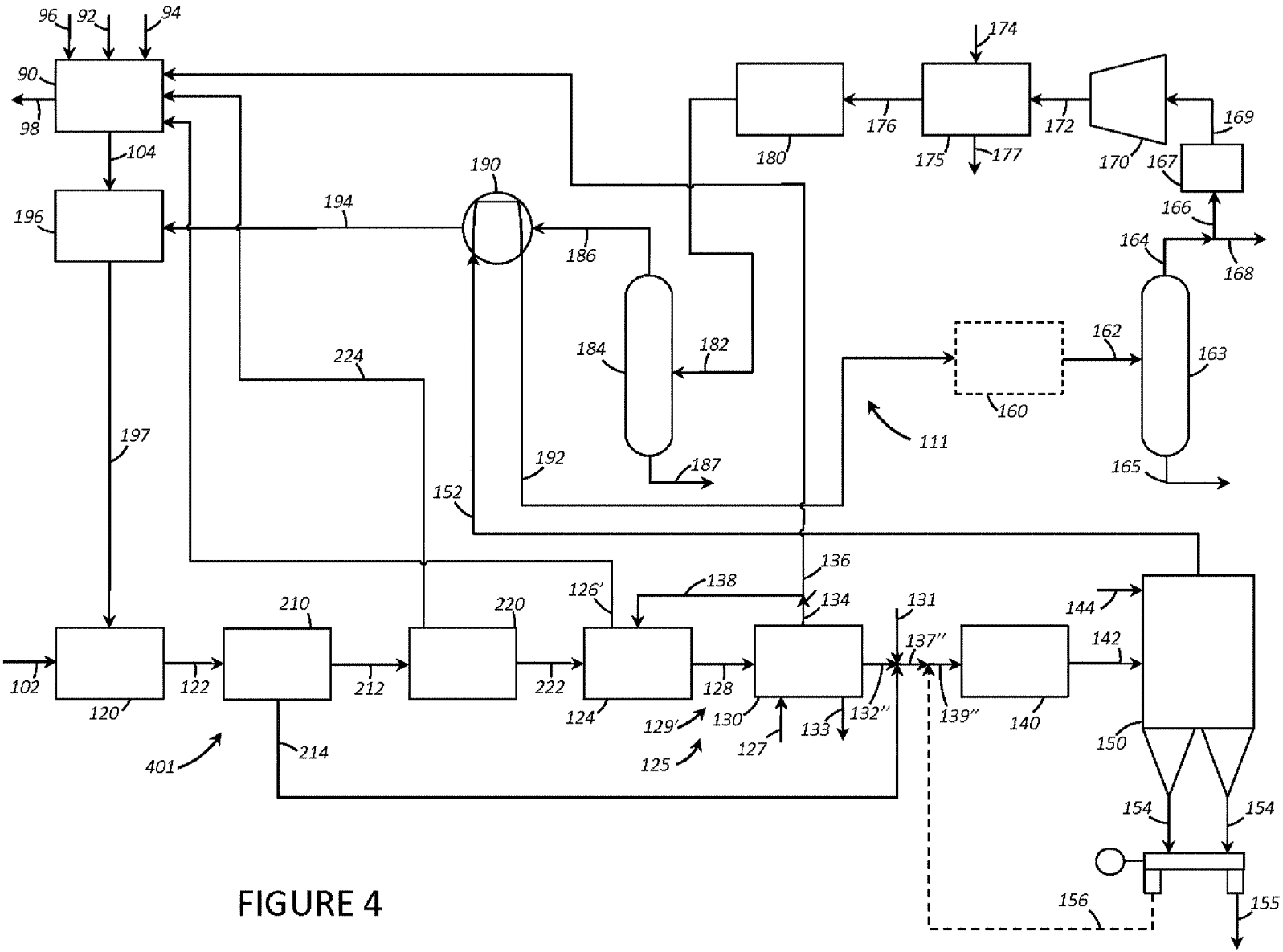
FIG. 4 is a schematic diagram of a process and an apparatus for regenerating catalyst from a fluidized catalytic process in accordance with yet another exemplary embodiment.

Yet another exemplary embodiment of a process and an apparatus for regenerating catalyst from a fluidized catalytic process is addressed with reference to a process and apparatus 401 as shown in FIG. 4. Elements of FIG. 4 may have the same configuration as in FIG. 3 and bear the same respective reference number and have similar operating conditions. The process and apparatus for regenerating catalyst from a fluidized catalytic process as shown in FIG. 4 comprise an oxygen source 90 for providing the oxygen stream 104 in addition to the elements shown in FIG. 3.

In an embodiment, the oxygen source 90 for providing the oxygen stream 104 can be selected from an air separation unit (ASU) or an electrolyzer. In an exemplary embodiment, the oxygen source 90 is an electrolyzer 90.

Various types of electrolyzers may be used as the electrolyzer 90 including but not limited to a polymer electrolyte membrane/proton exchange membrane (PEM/PEMEC), an alkaline electrolysis cell (AEC), an anion exchange membrane (AEM), and a solid oxide electrolysis cell (SOE/SOEC). In accordance with the present disclosure, the utilities generated in the fluidized catalytic process could be used in the electrolysis section of the electrolyzer 90. Specifically, the electricity generated in the flue gas expander 220, the superheated steam stream in line 126' and the saturated steam stream 136 from the HRSG 130 can be used in the electrolyzer 90. For PEM, AEC, AEM and SOEC electrolyzers, the electricity generated in a power recovery section could be used. In addition, for a SOEC electrolyzer, heat in the form of steam could be used in SOEC to reduce the need for utilities generated and exported into the process and apparatus 401. For the SOEC electrolyzer, about 25% to about 30% of the total energy requirement could be supplied by heat. In an exemplary embodiment, heat generated from FCC regenerator flue gas from the FCC unit may be supplied to the SOEC electrolyzer. Apart from taking heat generated from the FCC regenerator flue gas, other sources of heat are also envisioned for integration, such as heat taken from the main column overhead of the FCC unit. Furthermore, apart from using electricity for splitting water, electricity generated in the process unit as disclosed earlier could also be used for compression for the electrolyzer such as in AEC, AEM, and PEM electrolyzer. The electrolyzer may use the electricity generated in the expander turbine installed in the FCC regenerator flue gas section of the FCC unit as described herein above located upstream of the steam boiler and downstream of the TSS 210. In an exemplary embodiment, the electrolyzer 90 may use a portion of the electricity generated from the flue gas expander 220. In another exemplary embodiment, the electrolyzer 90 may use the thermal energy or steam generated in the FCC process.

Referring to FIG. 4, the oxygen source 90 is an electrolyzer 90. The electrolyzer 90 can be selected from one or more electrolyzers including but not limited to polymer electrolyte membrane/proton exchange membrane (PEM/PEMEC), alkaline electrolysis cell (AEC), anion exchange membrane (AEM), and solid oxide electrolysis cell (SOE/SOEC) as previously mentioned. An air stream in line 92, and a water stream in line 94 are provided to the electrolyzer 90. Heat 96 is also provided to the electrolyzer 90 from any suitable heat source. In an exemplary embodiment, the heat 96 to the electrolyzer 90 is supplied from any suitable process unit of the FCC unit. However, heat to the electrolyzer 90 can be supplied from any other heat sources. The various utilities generated in the FCC unit can be used in the electrolyzer 90. In embodiment, the electricity in line 224 from the flue gas expander 220, the superheated steam stream in line 126' from the superheated steam section 124 of the HRSG 129', and the saturated steam stream in line 136 from the saturated steam section 130 of the HRSG 129' are passed to the electrolyzer 90. Hydrogen produced in the electrolyzer 90 can be withdrawn in line 98. An oxygen stream is withdrawn in line 104 from the electrolyzer 90 and passed to the mixer 196. The rest of the process is the same as described in FIG. 3.

As a result of charging more mass of inert gas in the regenerator unit 120 due to the molecular weight increase of carbon dioxide over air, which is mostly nitrogen, in order to maintain the same volumetric flow rates as in the base case, the temperature in the regenerator unit 120 may drop. In order to keep the regenerator temperature constant, the following measures may be used: a) installing electric heating coils in the regenerator and using electricity generated within the process or from any source; or b) installing electric heater to further heat the preheated carbon dioxide recycle stream in line 194 and using electricity generated within the process or from any source; or c) firing fuel gas and/or natural gas directly in the regenerator; or d) continuously firing a direct fired air heater; or e) firing torch oil and/or FCC slurry oil in the FCC regenerator. Use of electricity for heating coils in the regenerator unit is a more sustainable and environmentally friendly measure. The present process includes using the electricity generated from the FCC process as disclosed above as a source of heat for the heating coils in the regenerator unit 120. In accordance with an exemplary embodiment, a portion (not shown) of the electricity in line 224 from the flue gas expander 220 can be used for heating coils in the regenerator unit 120. Alternatively, heat and/or electricity from any suitable renewable energy source or a fuel gas stream may also be used in the regenerator unit 120.

Figure 5:
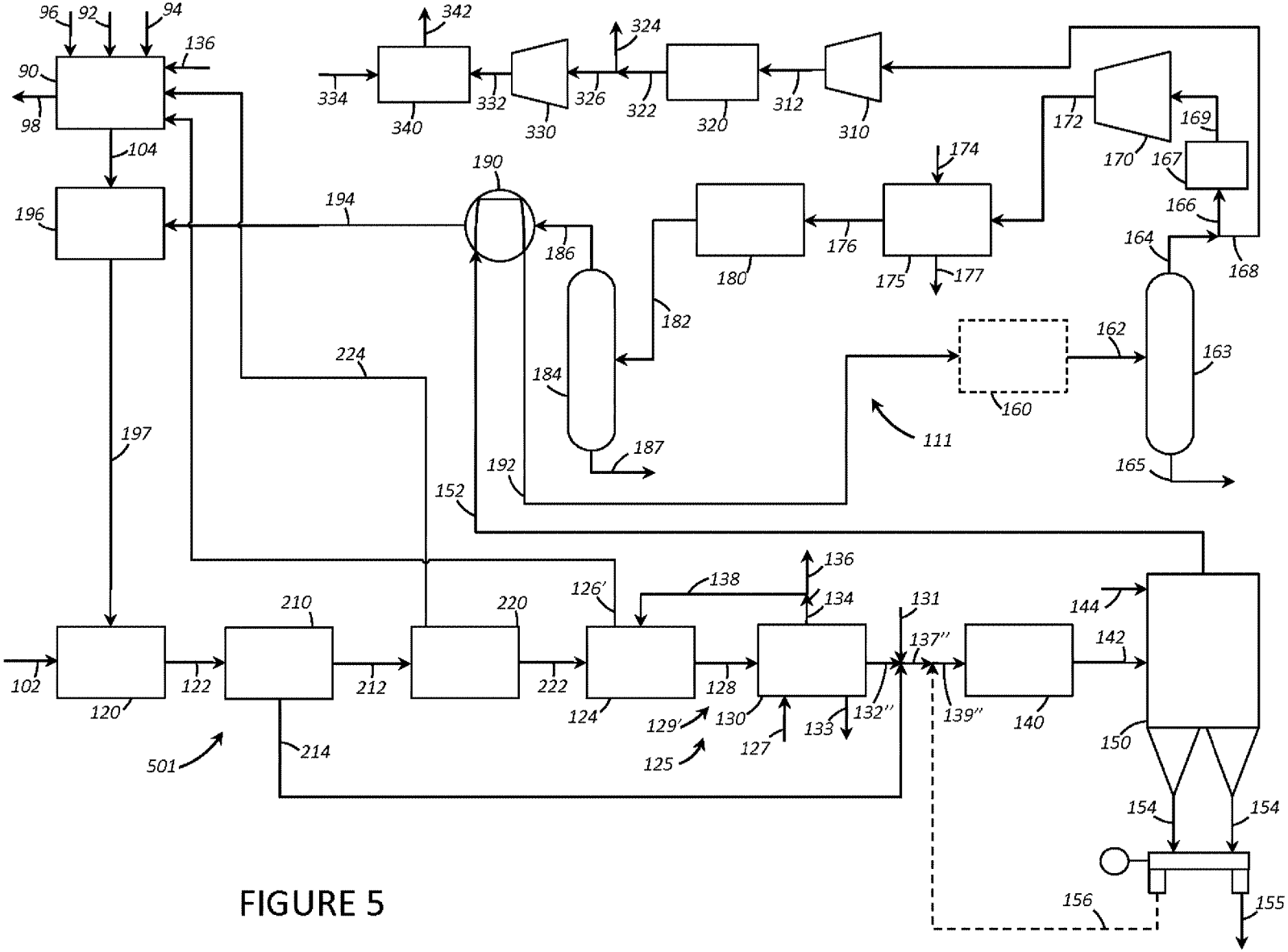
FIG. 5 is a schematic diagram of a process and an apparatus for regenerating catalyst from a fluidized catalytic process in accordance with yet another exemplary embodiment.

Yet another exemplary embodiment of a process and an apparatus for regenerating catalyst from a fluidized catalytic process is addressed with reference to a process and apparatus 501 as shown in FIG. 5. Elements of FIG. 5 may have the same configuration as in FIG. 4 and bear the same respective reference number and have similar operating conditions. The process and apparatus for regenerating catalyst from a fluidized catalytic process as shown in FIG. 5 comprise a methanol synthesis unit 80 for providing a methanol stream 86 in addition to the elements shown in FIG. 4.

In accordance with the process and the apparatus 501 as shown in FIG. 5, the separated carbon dioxide stream in line 168 may be passed to the methanol synthesis unit 340 for providing the methanol stream 342. For the process and the apparatus 501 with the methanol synthesis unit 340 as shown in FIG. 5, the regenerator unit 120 may be a partial burn unit or a complete burn unit. If the regenerator unit 120 operates in partial combustion, the CO present in the flue gas will be oxidized to CO2 prior to heat recovery, contaminant removal etc. As described herein above for the regenerator unit 120 under partial combustion mode, the flue gas stream in line 122 is sent to the CO combustor 124 to oxidize the carbon monoxide to CO2.

Methanol may be produced from the methanol synthesis unit 80 by hydrogenation of carbon dioxide over a methanol synthesis catalyst. A suitable methanol synthesis catalyst may be a copper on a zinc oxide and alumina support. Synthesis conditions include a temperature of about 200 to about 300° C. and about 3.5 to about 10 MPa. Reaction equilibrium typically requires methanol separation and recycle of unreacted reagents to the synthesis reaction. A methanol stream is provided in line 86. The methanol stream in line 86 may include methanol, dimethyl ether, ethanol or combinations thereof.

The carbon dioxide stream for methanol synthesis in line 168 may require preparation to be used for methanol synthesis. The methanol synthesis carbon dioxide stream should be compressed to methanol synthesis pressure. However, the methanol synthesis carbon dioxide stream in line 168 may require treatment in a pressure swing adsorption (PSA) unit or a thermal swing adsorption (TSA) unit for traces removal of contaminants like $SO_x$, $NO_x$, $NH_3$, $O_2$, and $H_2O$. Other particulate matter may be removed in the contaminant removal unit 190. Traces are removed from the separated carbon dioxide stream 168 to isolate the $CO_2$ which may be passed to the methanol synthesis unit 80.

In accordance with an exemplary embodiment as shown in FIG. 5, the methanol synthesis carbon dioxide stream in line 168 may be compressed in a treatment compressor 310 up to an intermediate pressure suitable for contaminant removal. A compressed synthesis carbon dioxide stream in line 312 may be fed to a contaminant removal unit 320 for removal of contaminants. A contaminant depleted carbon dioxide stream in line 322 emerges from the contaminant removal unit 320. A storage carbon dioxide stream in line 324 may be taken to storage from the contaminant depleted carbon dioxide stream in line 322. A contaminant depleted synthesis carbon dioxide stream may be taken in line 326 to methanol synthesis unit 340.

Prior to methanol synthesis, the contaminant depleted synthesis carbon dioxide stream in line 326 may be further compressed in a synthesis compressor 330 to synthesis pressure. A synthesis carbon dioxide stream is provided in line 332 to the methanol synthesis unit 340 for providing the methanol stream in line 342. Hydrogen in line 334 is also passed to the methanol synthesis unit 340. In accordance with an embodiment of the present disclosure, the hydrogen in line 334 may be selected from one or both of a blue hydrogen and a green hydrogen. In accordance with an exemplary embodiment the hydrogen in line 334 is blue hydrogen. In accordance with another exemplary embodiment, the hydrogen in line 334 is green hydrogen. Methanol stream in line 342 is withdrawn from the methanol synthesis unit 340.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect. Further, the figure may include one or more exemplary sensors located on one or more conduits. Nevertheless, there may be sensors present on every stream so that the corresponding parameter (s) can be controlled accordingly.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

EXAMPLE

A comparative analysis was conducted to demonstrate the lower utilities cost for dry scrubbing with the heat integration for carbon dioxide recycle stream as disclosed in the instant process as compared to a wet scrubbing without heat integration for carbon dioxide recycle stream. The results are shown in TABLES A and B as below:

TABLE A

| Capital Expenditures (CAPEX), MM$ | | | |
|---|---|---|---|
| For Wet Scrubbing | | For Dry scrubbing (DSI) | |
| Wet Scrubber | 10 | Dry Scrubbing (DSI) | 10 |
| carbon dioxide (CO2) recycle compressor | 9.5 | carbon dioxide (CO2) recycle compressor | 9 |
| LP steam generation | 5.2 | LP steam generation | 4.3 |
| Discharge air cooler | 0.57 | Discharge air cooler | 0.44 |
| MP steam heater | 5.2 | Compressor suction air cooler | 0.28 |
| | | carbon dioxide (CO2) recycle preheat exchanger | 6 |
| Total CAPEX | 30.47 | Total CAPEX | 30.02 |

TABLE B

| Operational Utility Costs (OPEX), MM$ | | | | | |
|---|---|---|---|---|---|
| For Wet Scrubbing | | | For Dry scrubbing (DSI) | | |
| Caustic | 654 kg/hr | −3.5 MM$/yr.. | NaHCO3 consumed | 40 T/day | −5.6 MM$/yr. |
| MP steam required to heat the carbon dioxide (CO2) recycle stream | 15.6 TPH | −2.5 MM$/yr.. | carbon dioxide (CO2) credit of less energy consumption | 16320 MT/yr. carbon dioxide (CO2) reduction | +0.57 MM$/yr. |
| Air cooler power | 300 kw | −0.2 MM$/yr. | Air cooler power | 300 kw | −0.2 MM$/yr. |

TABLE B-continued

| Operational Utility Costs (OPEX), MM$ | | | | | |
|---|---|---|---|---|---|
| For Wet Scrubbing | | | For Dry scrubbing (DSI) | | |
| LP steam generation | 14.5 TPH | +2.1 MM$/yr. | LP steam generation | 11 TPH | +1.6 MM$/yr. |
| Make- UP water | 50 m3/hr | −0.8 MM$/yr. | Sodium sulphate produced | Considered to be valued at 45% of NaHCO3 cost | +2.52 MM$/yr. |
| Power | 682 kwh | −0.46 MM$/yr. | | | |
| Additional carbon dioxide (CO2) recycle compressor power | 1640 kw | −1.1 MM$/yr. | | | |
| Total OPEX | | 6.46 MM$/yr. | Total OPEX | | 1.11 MM$/yr. |

* CO2 credit of 35$/MT was considered

From the above Tables it is evident that the process including dry scrubbing with the heat integration for carbon dioxide recycle stream provides a net operational utility costs savings of 6.46-1.11=5.35 MM$/yr. for almost the same capital expenditures as compared to the wet scrubbing without the heat integration for carbon dioxide recycle stream.

Specific Embodiments

While the following is described in conjunction with specific embodiments, it will be understood that this description is intended to illustrate and not limit the scope of the preceding description and the appended claims.

A first embodiment of the present disclosure is a process for regenerating catalyst from a fluidized catalytic process comprising providing an oxygen stream and a preheated carbon dioxide recycle stream; mixing the oxygen stream and the preheated carbon dioxide recycle stream to provide a carbon dioxide rich oxidation stream; passing the carbon dioxide rich oxidation stream to a regenerator unit to provide a carbon dioxide rich flue gas stream; reacting one or more of a sulfur-containing compound, a nitrogen-containing compound, or both in the carbon dioxide rich flue gas stream with a reactant in a decontamination reactor to form a reactor effluent stream comprising reactant salt; filtering the reactor effluent stream to remove the reactant salt and catalyst fines to produce a filtered reactor effluent stream; and taking a carbon dioxide recycle stream from the filtered reactor effluent stream. An embodiment of the present disclosure is one, any or all of prior embodiments in this paragraph up through the first embodiment in this paragraph further comprising pre-heating the carbon dioxide recycle stream by heat exchange with the filtered reactor effluent stream to provide the preheated carbon dioxide recycle stream. An embodiment of the present disclosure is one, any or all of prior embodiments in this paragraph up through the first embodiment in this paragraph wherein the reactant is in dry form. An embodiment of the present disclosure is one, any or all of prior embodiments in this paragraph up through the first embodiment in this paragraph wherein the decontamination reactor operates at a temperature from about 200° C. to about 600° C. for reacting one or more of the sulfur-containing compound, the nitrogen-containing compound, or both in the carbon dioxide rich flue gas stream with the reactant. An embodiment of the present disclosure is one, any or all of prior embodiments in this paragraph up through the first embodiment in this paragraph wherein the carbon dioxide rich oxidation stream comprises an oxygen concentration of no more than 30 mole %. An embodiment of the present disclosure is one, any or all of prior embodiments in this paragraph up through the first embodiment in this paragraph wherein the oxygen stream is provided from an electrolyzer or an air separation unit. An embodiment of the present disclosure is one, any or all of prior embodiments in this paragraph up through the first embodiment in this paragraph further comprising transferring heat from the carbon dioxide rich flue gas stream to a boiler feed water stream in a heat recovery section to form a partially cooled carbon dioxide rich flue gas stream and a steam stream. An embodiment of the present disclosure is one, any or all of prior embodiments in this paragraph up through the first embodiment in this paragraph, wherein the heat recovery section is a heat recovery steam generator (HRSG) comprising transferring heat from the carbon dioxide rich flue gas stream to a boiler feed water stream in the HRSG to form the partially cooled carbon dioxide rich flue gas stream and the steam stream; and passing the partially cooled carbon dioxide rich flue gas stream to the decontamination reactor. An embodiment of the present disclosure is one, any or all of prior embodiments in this paragraph up through the first embodiment in this paragraph further comprising separating the carbon dioxide rich oxidation stream into a first portion and a second portion; passing the first portion of carbon dioxide rich oxidation stream to the regenerator unit; and passing the second portion of carbon dioxide rich oxidation stream to the heat recovery section. An embodiment of the present disclosure is one, any or all of prior embodiments in this paragraph up through the first embodiment in this paragraph wherein the heat recovery section is a heat recovery section of a carbon monoxide (CO) boiler. An embodiment of the present disclosure is one, any or all of prior embodiments in this paragraph up through the first embodiment in this paragraph wherein the fluidized catalytic process is selected from a fluid catalytic cracking (FCC) process, a methanol to olefins (MTO) process or both. An embodiment of the present disclosure is one, any or all of prior embodiments in this paragraph up through the first embodiment in this paragraph further comprising passing the carbon dioxide rich flue gas stream to a third stage separator (TSS) to separate catalyst fines in an underflow stream and provide a carbon dioxide rich flue gas stream with reduced catalyst fines in an overflow stream; generating electricity from the overflow stream in an expander; and passing the overflow stream to the heat recovery section. An embodiment of the present disclosure is one, any or all of prior embodiments in this paragraph up through the first embodiment in this paragraph wherein the reactant salt comprises one or more of sodium sulphate ($Na_2SO_4$), sodium carbonate ($Na_2CO_3$) and sodium nitrate ($NaNO_3$). An embodiment of the present disclosure is one, any or all of prior embodiments in this paragraph up through the first embodiment in this paragraph further comprising heat exchanging the filtered reactor effluent stream with the carbon dioxide recycle stream in the heat exchanger to provide the preheated carbon dioxide recycle stream and a partially cooled filtered reactor effluent stream; optionally cooling the partially cooled filtered reactor effluent stream to provide a cooled filtered reactor effluent stream; separating water from the cooled filtered reactor effluent stream to provide a carbon dioxide stream; and separating the carbon dioxide stream into the carbon dioxide recycle stream and a separated carbon dioxide stream. An embodiment of the present disclosure is one, any or all of prior embodiments in this paragraph up through the first embodiment in this paragraph further comprising compressing the carbon dioxide recycle stream to provide a compressed carbon dioxide recycle stream; passing the compressed carbon dioxide recycle stream to a low-pressure steam generator to provide a low-pressure steam stream and a partially cooled carbon dioxide recycle stream; cooling the partially cooled carbon dioxide recycle stream to provide a cooled carbon dioxide recycle stream; separating water from the cooled carbon dioxide recycle stream to provide a dry carbon dioxide recycle stream; preheating the dry carbon dioxide recycle stream by heat exchanging the filtered reactor effluent stream with the dry carbon dioxide recycle stream to provide a preheated dry carbon dioxide recycle stream; and passing the preheated dry carbon dioxide recycle stream to the regenerator unit. An embodiment of the present disclosure is one, any or all of prior embodiments in this paragraph up through the first embodiment in this paragraph further comprising heating the recycle carbon dioxide stream to provide a warm carbon dioxide recycle stream; and recycling the warm carbon dioxide recycle stream to the regenerator unit. An embodiment of the present disclosure is one, any or all of prior embodiments in this paragraph up through the first embodiment in this paragraph further comprising passing said separated carbon dioxide stream to a methanol synthesis unit for providing a methanol stream. An embodiment of the present disclosure is one, any or all of prior embodiments in this paragraph up through the first embodiment in this paragraph wherein the HRSG comprises a superheated steam section and a saturated steam section. An embodiment of the present disclosure is one, any or all of prior embodiments in this paragraph up through the first embodiment in this paragraph further comprising passing the carbon dioxide rich flue gas stream into the superheated steam section of the HRSG to produce a superheated steam stream and a heat exchanged carbon dioxide rich flue gas stream, passing a boiler feed water stream and the heat exchanged carbon dioxide rich flue gas stream into the saturated steam section of the HRSG to form the partially cooled carbon dioxide rich flue gas stream and a saturated steam stream; introducing at least a portion of the saturated steam stream into the superheated steam section of the HRSG; and superheating the saturated steam stream with the carbon dioxide rich flue gas stream to produce the superheated steam stream.

A second embodiment of the present disclosure is a process for regenerating catalyst from a fluidized catalytic process comprising providing an oxygen stream and a preheated carbon dioxide recycle stream; mixing the oxygen stream and the preheated carbon dioxide recycle stream to provide a carbon dioxide rich oxidation stream; separating the $CO_2$ rich oxidation stream into a first portion and a second portion; passing the first portion of the carbon dioxide rich oxidation stream to a regenerator unit to provide a carbon dioxide rich flue gas stream; passing the second portion of the $CO_2$ rich oxidation stream to heat recovery section to provide a partially cooled carbon dioxide rich flue gas stream and a steam stream; reacting one or more of a sulfur-containing compound, a nitrogen-containing compound, or both in the partially cooled carbon dioxide rich flue gas stream with a reactant in a decontamination reactor to form a reactor effluent stream comprising reactant salt; filtering the reactor effluent stream to remove the reactant salt and catalyst fines to produce a filtered reactor effluent stream; and taking a carbon dioxide recycle stream from the filtered reactor effluent stream.

A third embodiment of the present disclosure is an apparatus for regenerating catalyst comprising a heat recovery section comprising a superheated steam section and a saturated steam section; the superheated steam section having a flue gas inlet, a flue gas outlet, a saturated steam inlet, and a superheated steam outlet, the flue gas inlet of the superheated steam section in fluid communication with an outlet of a regenerator unit; and the saturated steam section having a flue gas inlet, a flue gas outlet, a boiler feed water inlet, and a saturated steam outlet, the flue gas inlet of the saturated steam section in fluid communication with the flue gas outlet of the superheated steam section, the saturated steam outlet of the saturated steam section in fluid communication with the saturated steam inlet of the superheated steam section; a decontamination reactor having a flue gas inlet, a flue gas outlet, and a reactant inlet, the flue gas inlet of the decontamination reactor in fluid communication with a flue gas outlet of the saturated steam section; a filter section having a flue gas inlet, a flue gas outlet, and a filter material outlet, flue gas inlet of the filter section in fluid communication with the flue gas outlet of the decontamination reactor inlet; a heat exchanger having a flue gas inlet and a flue gas outlet, the flue gas inlet of the heat exchanger in fluid communication with the flue gas outlet of the filter section; and a carbon dioxide separation unit in fluid communication with the flue gas outlet of the heat exchanger, the carbon dioxide separation unit is in thermal communication with the flue gas outlet of the filter section via a carbon dioxide recycle stream in the heat exchanger.

Without further elaboration, it is believed that using the preceding description that one skilled in the art can utilize the present disclosure to its fullest extent and easily ascertain the essential characteristics of this disclosure, without departing from the spirit and scope thereof, to make various changes and modifications of the disclosure and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for regenerating catalyst from a fluidized catalytic process comprising:

providing an oxygen stream and a preheated carbon dioxide recycle stream;

mixing said oxygen stream and said preheated carbon dioxide recycle stream to provide a carbon dioxide rich oxidation stream;

passing said carbon dioxide rich oxidation stream to a regenerator unit to provide a carbon dioxide rich flue gas stream;

reacting one or more of a sulfur-containing compound, a nitrogen-containing compound, or both in said carbon dioxide rich flue gas stream with a reactant in a decontamination reactor to form a reactor effluent stream comprising reactant salt;

filtering the reactor effluent stream to remove the reactant salt and catalyst fines to produce a filtered reactor effluent stream;

compressing said filtered reactor effluent stream to provide a compressed filtered reactor effluent stream; and recycling said compressed filtered reactor effluent stream to said regenerator unit.

2. The process of claim 1 further comprising taking a carbon dioxide recycle stream from the filtered reactor effluent stream.

3. The process of claim 2 further comprising:

heat exchanging said filtered reactor effluent stream with said carbon dioxide recycle stream in the heat exchanger to provide said preheated carbon dioxide recycle stream and a partially cooled filtered reactor effluent stream;

optionally cooling said partially cooled filtered reactor effluent stream to provide a cooled filtered reactor effluent stream;

separating water from said cooled filtered reactor effluent stream to provide a carbon dioxide stream; and separating said carbon dioxide stream into said carbon dioxide recycle stream and a separated carbon dioxide stream.

4. The process of claim 3 further comprising:

compressing said carbon dioxide recycle stream to provide a compressed carbon dioxide recycle stream;

passing the compressed carbon dioxide recycle stream to a low-pressure steam generator to provide a low-pressure steam stream and a partially cooled carbon dioxide recycle stream;

cooling said partially cooled carbon dioxide recycle stream to provide a cooled carbon dioxide recycle stream;

separating water from the cooled carbon dioxide recycle stream to provide a dry carbon dioxide recycle stream;

preheating said dry carbon dioxide recycle stream by heat exchanging said filtered reactor effluent stream with said dry carbon dioxide recycle stream to provide a preheated dry carbon dioxide recycle stream; and passing said preheated dry carbon dioxide recycle stream to said regenerator unit.

5. The process of claim 3 further comprising:

heating said recycle carbon dioxide stream to provide a warm carbon dioxide recycle stream; and recycling said warm carbon dioxide recycle stream to said regenerator unit.

6. The process of claim 3 further comprising passing said separated carbon dioxide stream to a methanol synthesis unit for providing a methanol stream.

7. The process of claim 1 wherein the reactant is in dry form.

8. The process of claim 1 wherein said decontamination reactor operates at a temperature from about 200° C. to about 600° C. for reacting one or more of the sulfur-containing compound, the nitrogen-containing compound, or both in said carbon dioxide rich flue gas stream with the reactant.

9. The process of claim 1 wherein the carbon dioxide rich oxidation stream comprises an oxygen concentration of no more than 30 mole %.

10. The process of claim 1 wherein said oxygen stream is provided from an electrolyzer or an air separation unit.

11. The process of claim 1 further comprising transferring heat from said carbon dioxide rich flue gas stream to a boiler feed water stream in a heat recovery section to form a partially cooled carbon dioxide rich flue gas stream and a steam stream.

12. The process of claim 11, wherein said heat recovery section is a heat recovery steam generator (HRSG) comprising:

transferring heat from said carbon dioxide rich flue gas stream to a boiler feed water stream in said HRSG to form said partially cooled carbon dioxide rich flue gas stream and said steam stream; and passing the partially cooled carbon dioxide rich flue gas stream to the decontamination reactor.

13. The process of claim 12 wherein the HRSG comprises a superheated steam section and a saturated steam section and further comprising:

passing said carbon dioxide rich flue gas stream into the superheated steam section of said HRSG to produce a superheated steam stream and a heat exchanged carbon dioxide rich flue gas stream, passing a boiler feed water stream and the heat exchanged carbon dioxide rich flue gas stream into the saturated steam section of the HRSG to form said partially cooled carbon dioxide rich flue gas stream and a saturated steam stream;

introducing at least a portion of the saturated steam stream into the superheated steam section of the HRSG; and superheating the saturated steam stream with said carbon dioxide rich flue gas stream to produce the superheated steam stream.

14. The process of claim 11 further comprising:

separating said carbon dioxide rich oxidation stream into a first portion and a second portion;

passing the first portion of carbon dioxide rich oxidation stream to said regenerator unit; and passing the second portion of carbon dioxide rich oxidation stream to said heat recovery section.

15. The process of claim 11 wherein said heat recovery section is a heat recovery section of a CO combustor.

16. The process of claim 1 wherein said fluidized catalytic process is selected from a fluid catalytic cracking (FCC) process, a methanol to olefins (MTO) process or both.

17. The process of claim 1 further comprising:

passing said carbon dioxide rich flue gas stream to a third stage separator (TSS) to separate catalyst fines in an underflow stream and provide a carbon dioxide rich flue gas stream with reduced catalyst fines in an overflow stream;

passing said underflow stream to said decontamination reactor to form said reactor effluent stream comprising reactant salt; and generating electricity from said overflow stream in an expander; and passing said overflow stream to a heat recovery section.

18. The process of claim 1 wherein the reactant salt comprises one or more of sodium sulphate (Na2SO4), sodium carbonate (Na2CO3) and sodium nitrate (NaNO3).

19. A process for regenerating catalyst from a fluidized catalytic process comprising:

providing an oxygen stream and a preheated carbon dioxide recycle stream;

mixing said oxygen stream and said preheated carbon dioxide recycle stream to provide a carbon dioxide rich oxidation stream;

separating said carbon dioxide rich oxidation stream into a first portion and a second portion;

passing the first portion of said carbon dioxide rich oxidation stream to a regenerator unit to provide a carbon dioxide rich flue gas stream;

passing the second portion of said carbon dioxide rich oxidation stream to heat recovery section to provide a partially cooled carbon dioxide rich flue gas stream and a steam stream;

reacting one or more of a sulfur-containing compound, a nitrogen-containing compound, or both in said partially cooled carbon dioxide rich flue gas stream with a reactant in a decontamination reactor to form a reactor effluent stream comprising reactant salt;

filtering the reactor effluent stream to remove the reactant salt and catalyst fines to produce a filtered reactor effluent stream;

compressing said filtered reactor effluent stream to provide a compressed filtered reactor effluent stream; and recycling said compressed filtered reactor effluent stream to said regenerator unit.

* * * * *